US007678001B2

(12) United States Patent
Seeber

(10) Patent No.: US 7,678,001 B2
(45) Date of Patent: Mar. 16, 2010

(54) APPARATUS FOR THE INTERMITTENT DRIVE OF A SPINDLE FOR A WORKPIECE FIXTURE, ESPECIALLY A FORGING MACHINE

(75) Inventor: Alfred Seeber, Steyr (AT)

(73) Assignee: GFM Beteiligungs- und Management m.b.H. & Co. KG, Steyr (AT)

( * ) Notice: Subject to any disclaimer, the term of this patent is extended or adjusted under 35 U.S.C. 154(b) by 559 days.

(21) Appl. No.: 11/137,000

(22) Filed: May 25, 2005

(65) Prior Publication Data

US 2005/0272543 A1 Dec. 8, 2005

(30) Foreign Application Priority Data

May 26, 2004 (AT) ..... A 905/2004

(51) Int. Cl.
*F16H 29/20* (2006.01)
*F16H 7/12* (2006.01)

(52) U.S. Cl. ..... 474/135; 474/101; 474/109; 74/89.22; 74/89.21; 74/89.2

(58) Field of Classification Search ..... 474/101, 474/109, 133, 134, 135; 74/89, 89.2, 89.21, 74/89.22

See application file for complete search history.

(56) References Cited

U.S. PATENT DOCUMENTS 315,735 A * 4/1885 Colburn ..... 474/134
952,156 A * 3/1910 Trewhella ..... 474/131
976,115 A * 11/1910 Bard ..... 474/134
1,016,787 A * 2/1912 Sewall ..... 474/109
2,425,476 A * 8/1947 Lade et al. ..... 211/119.09
2,584,512 A * 2/1952 Strait ..... 305/20
2,900,831 A * 8/1959 Wilson et al. ..... 474/87
3,611,770 A * 10/1971 Kralowetz ..... 72/76
4,564,098 A * 1/1986 Hormann ..... 192/150
4,758,208 A * 7/1988 Bartos et al. ..... 474/135
4,929,218 A * 5/1990 Clough ..... 474/83
5,000,028 A * 3/1991 Krieger ..... 72/421
5,067,423 A * 11/1991 Thompson ..... 112/220
5,221,236 A * 6/1993 Raymer et al. ..... 474/109
5,676,447 A * 10/1997 Menke ..... 362/35
6,312,352 B1 * 11/2001 Holland et al. ..... 474/113
6,648,783 B1 * 11/2003 Bogner ..... 474/134
6,830,524 B2 * 12/2004 Tamai ..... 474/134
7,367,908 B2 * 5/2008 Lemberger et al. ..... 474/138
2002/0026813 A1 * 3/2002 Blaszyk et al. ..... 65/402
2002/0039944 A1 * 4/2002 Ali et al. ..... 474/135
2002/0086751 A1 * 7/2002 Bogner et al. ..... 474/134
2003/0220164 A1 * 11/2003 Tamai ..... 474/134

FOREIGN PATENT DOCUMENTS

AT 278481 2/1970

* cited by examiner

*Primary Examiner*—Bradley T King
*Assistant Examiner*—Thomas W Irvin
(74) *Attorney, Agent, or Firm*—Collard & Roe, P.C.

(57) ABSTRACT

An apparatus is described for the intermittent drive of a spindle (1) for a workpiece fixture, especially a forging machine, comprising a traction gear (7) consisting of a traction means (13) guided endlessly about a driving wheel (6) and a driven wheel (8), a continuous rotary drive (5) for the driving wheel (6) and a superposition drive (10) performing rotary oscillations. In order to provide advantageous constructional conditions it is proposed that the superposition drive (10) comprises a support (11) which can be displaced in a rotary oscillating manner about the axis of the driven wheel (8), and deflection rollers (12) held on the support (11) for the traction strands (14) moving towards and away from the driving wheel (6).

5 Claims, 2 Drawing Sheets

APPARATUS FOR THE INTERMITTENT DRIVE OF A SPINDLE FOR A WORKPIECE FIXTURE, ESPECIALLY A FORGING MACHINE

FIELD OF THE INVENTION

The invention relates to an apparatus for the intermittent drive of a spindle for a workpiece fixture, especially a forging machine, comprising a traction gear consisting of a traction means guided endlessly about a driving wheel and a driven wheel, a continuous rotary drive for the driving wheel and a superposition drive performing rotary oscillations.

DESCRIPTION OF THE PRIOR ART

During swaging, the workpiece which is held via a clamping head and is driven by a spindle is tightly held against co-rotation with the spindle by the forging tools during the application of the forging tools. This leads to a torsional strain on the workpiece if a respective intermittent drive for the spindle is not provided. For this purpose it is known (AT 278 481 B) to drive the spindle via a worm gear pair whose worm, which is axially held in a displaceable manner in a hollow drive shaft, rests axially on a spring brake. The continuous rotary drive of the worm via a belt drive can thus be overlapped by a rotary oscillating drive by the worm gear when the worm is axially displaced. This axial displacement occurs when the workpiece is fixed by the forging tools, with the spring brake tensioned in this fashion ensuring an axial restoring movement of the worm once the workpiece has been released again by the forging tools. When providing a respective adaptation of the resonance behavior of the spring brake on the oscillating drive system, an intermittent drive for the spindle can be achieved which is synchronous with the drive of the forging tools. The disadvantageous aspect in this known drive apparatus for the spindle of a forging machine are the comparatively high constructional efforts. Moreover, the arrangement of the spring brake in axial extension of the worm of the worm gear pair impairs access to the spring elements of the spring brake, which makes more difficult the adjustment of the oscillating frequency of the superposition gear to the impact frequency of the forging tool by exchanging the spring elements of the spring break.

SUMMARY OF THE INVENTION

The invention is thus based on the object of providing an apparatus for the intermittent drive of a spindle for a workpiece fixture, especially a forging machine, of the kind mentioned above in such a way that the constructional effort is reduced and the adjustment of the rotary-oscillating superposition drive to the respective requirements can be facilitated.

This object is achieved by the invention in such a way that the superposition drive comprises a support which can be displaced in a rotary oscillating manner about the axis of the driven wheel and deflection rollers held on the support for the traction strands moving towards and away from the driving wheel.

Since as a result of these measures the superposition drive with the traction gear is joined into one module, simple constructional conditions are thus obtained. It is merely necessary to provide a support with deflection rollers which is displaceable in a rotary oscillating manner about the axis of the driven wheel for the traction strands on the incoming and outgoing sides concerning the driving wheel. When the support is rotated about the axis of the driven wheel, the traction strand between the driven wheel and the deflection roller extends on the one side, whereas the traction strand between the driving wheel and the deflection roller shortens on the other side, requiring a compensation via the traction strand guided via the driven wheel between deflection rollers on both sides, leading to a rotational movement of the driven wheel by its displacement. The rotation back and forth of the support thus displaces the driven wheel in a rotary oscillating manner, so that the continuous rotary drive of the driving wheel is superimposed with rotary oscillations, leading to an intermittent drive of the driven wheel. The rotary oscillation of the support about the axis of the driven wheel which is required for the intermittent drive of the driven wheel can be achieved in different ways depending on the respective requirements, so that advantageous possibilities for adjustment are opened up.

If the deflection rollers are held in a central position of the support symmetrically to a common axial plane of the drive and driven wheel, simple constructional conditions are obtained because the extensions and reductions of the traction strands on both sides of the driving wheel can be substantially adjusted to each other, which allows omitting additional tensioning devices for the traction means.

A further constructional simplification is obtained when the driven wheel projects between the deflection rollers on both sides and the traction strand is guided between the deflection rollers on both sides over the circumferential sections of the driven wheel which projects between the deflection rollers. However, such a guidance of the traction means demands a traction means which cooperates on its inner side with the driving wheel and on its outside with the driven wheel.

As already explained above, there are different possibilities for the rotary oscillating drive of the support about the axis of the driven wheel, especially since there are no limiting constructional conditions that are imposed on the support. The support for the deflection rollers can be linked in a simple way to a spring brake which ensures the intermittent drive for the spindle by resonance-induced rotary oscillations of the support after an excitation by periodic fixing of the workpiece driven by the spindle. It is also possible to drive the support for the deflection rollers via an oscillating drive which is controlled depending on the tool drive. In the case of changes in the region of the tool drive this would render superfluous an adjustment of the spring brake which would otherwise be required.

Ropes, belts or chains can be used as a traction means for the traction gear. Especially advantageous constructional conditions are obtained however when the traction gear is arranged as a toothed-belt gear, because an interlocking connection is achieved between the drive and driven wheel with the toothed belt without any special constructional effort.

BRIEF DESCRIPTION OF THE DRAWINGS

The subject matter of the invention is shown by way of example in the drawings, wherein.

DESCRIPTION OF THE PREFERRED EMBODIMENTS

Figure 1:
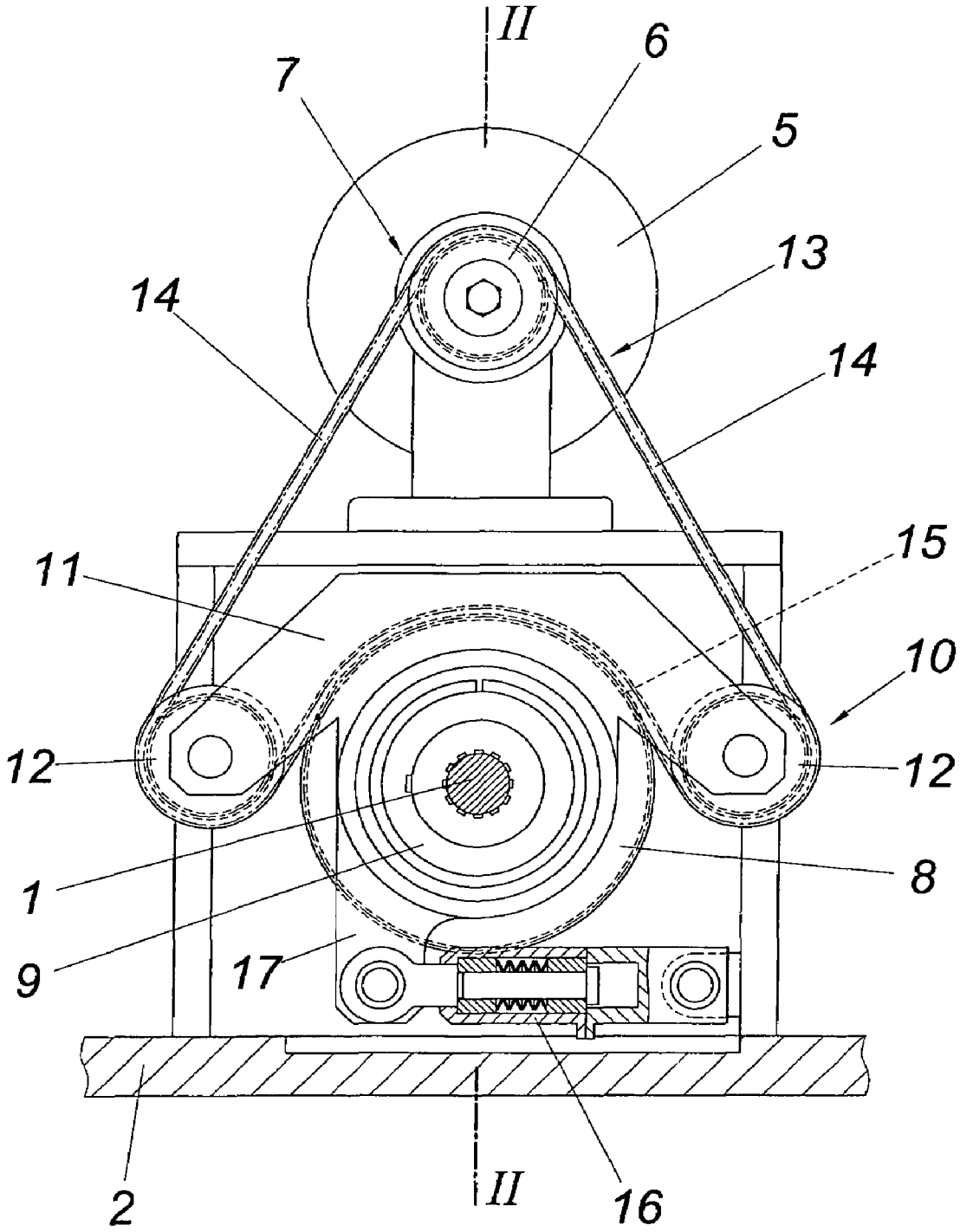
FIG. 1 shows an apparatus in accordance with the invention for the intermittent drive of a spindle for a workpiece fixture in a simplified face view.
Figure 2:
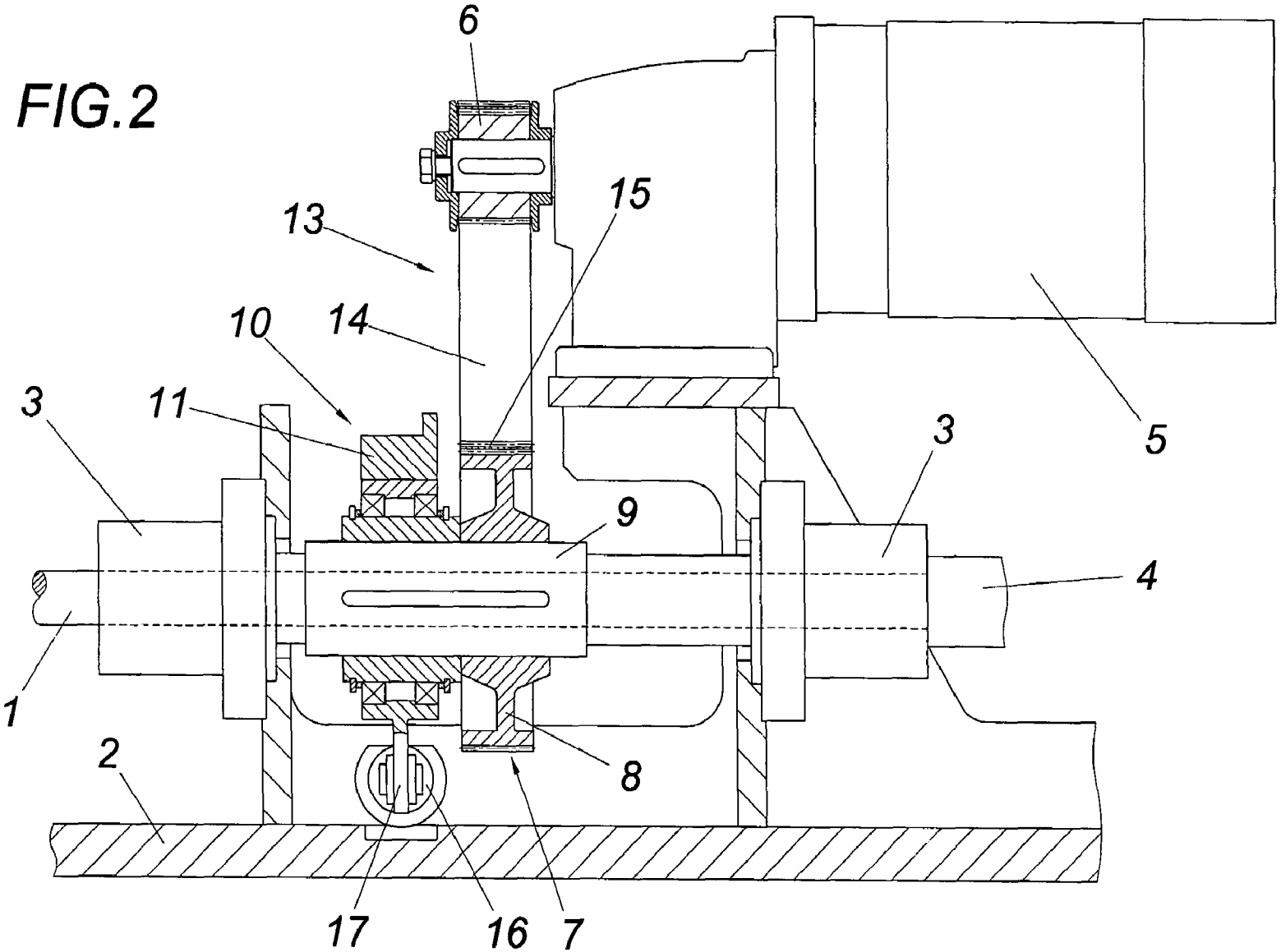
FIG. 2 shows this apparatus in a sectional view along line II-II of FIG. 1.

The illustrated apparatus for the intermittent drive of a spindle 1 for a workpiece fixture, especially a clamping head for a forging workpiece, comprises a frame 2 in which the spindle 1 is not only rotatable via bearing 3, but is also held in an axially displaceable manner. An actuating cylinder 4 is used for the axial displacement. A rotary drive 5 is provided for rotating the spindle 1, which drive is in drive connection with the driving wheel 6 of a traction gear 7. The driven wheel 8 of the traction gear 7 sits on a hollow shaft 9 which is configured as a multi-groove shaft for receiving the spindle 1 in a torsionally rigid, but axially displaceable manner. Instead of the spindle 1 which is axially displaceable relative to the rotary drive 5, the spindle could also be axially displaced with the rotary drive 5.

The traction gear 7 is combined with a superposition drive 10 into a module in order to enable the intermittent drive of the spindle 1 via the driven wheel 8. A support 11 is provided for this purpose on the hollow shaft 9 for two deflection rollers 12 which are provided on either side of the driven wheel 8 and over which the traction means 13 of the traction gear 7 (which in this embodiment is a toothed belt) is guided in an endless fashion, as is shown especially in FIG. 1. The arrangement has been made in such a way that in a central position of the support 11 as shown in FIG. 1 the two deflection rollers 12 lie symmetrically relative to a common axial plane through the driving wheel 6 and the driven wheel 8 of the traction gear 7. When the support is twisted from the middle position, one of the two traction strands 14 between the driving wheel 8 on the one hand and the two deflection rollers 12 on the other hand is extended and the other is shortened, leading to a displacement of traction strand 15 guided via the driven wheel between the deflection rollers 12 for length compensation of the traction strands 14 and thus produces a rotation of the driven wheel 8. Since this rotation of the driven wheel 8 depends on the rotational direction of the support 11, the driven wheel 8 can be rotated back and forth by a rotary oscillating drive of the support 11, with said rotary oscillating drive of the driven wheel 8 being superimposed on the continuous circulatory movement of the traction means 13 by the driven driving wheel 6 and thus ensuring the required intermittent drive for the spindle 1.

A spring brake 16 is provided for the rotary oscillating drive of the support 11, which spring brake is linked on the one hand to the frame 2 and on the other hand to an arm 17 of the support 11. Said spring brake 16, which can be tensioned from the illustrated middle position according to FIG. 1 towards both sides, is tensioned via support 11 on fixing the forging workpiece by the forging tools which attack the same when as a result of the continuously driven traction means 13 the deflection rollers 12 are rotated about the axis of the driven wheel 8 relative to the driven wheel 8 fixed with the spindle 1. The energy stored in the spring brake 16 is used for returning the support 11, whereas the spindle 1 is released by the forging tools, so that the support 11 is provided with a rotary oscillating drive excited by the forging tools with the effect that the spindle 1, despite the continuous rotary drive 5, is driven synchronously in an intermittent manner relative to the forging tools.

It is understood that the rotary oscillating drive of the support 11 need not occur in any way by a spring brake 16. It is possible to use different oscillation drives as long as it is ensured that said oscillation drives are controlled synchronously with respect to the drive of the forging tools.

The invention claimed is:

1. An apparatus for an intermittent drive of a spindle for a workpiece fixture comprising:

(a) a traction gear comprising a traction means guided endlessly about a driving wheel and a driven wheel;

(b) a continuous rotary drive for continuously driving the wheel in a driving direction; and (c) a superposition drive for displacing the driven wheel in a rotary oscillating manner;

wherein the superposition drive comprises a single support for the traction means, the support being connected to a rotary oscillating drive and displaceable in a rotary oscillating manner about an axis of the driven wheel, and two deflection rollers held on the single support for the traction means and moving synchronously towards and away from the driving wheel;

wherein the driven wheel is rotated back and forth via the rotary oscillating drive so that the continuous rotary drive of the driving wheel is superimposed with rotary oscillations leading to intermittent driving of the driven wheel.

2. An apparatus according to claim 1, wherein the deflection rollers are held in a central position of the support symmetrically relative to a common axial plane of the drive and driven wheel.

3. An apparatus according to claim 1, wherein the driven wheel projects between the deflection rollers on both sides and the traction means is guided between the deflection rollers on both sides over the circumferential section of the driven wheel, which section projects between the deflection rollers.

4. An apparatus according to claim 1, wherein the rotary oscillating drive comprises a spring brake and the support for the deflection rollers rests on the spring brake.

5. An apparatus according to claim 1, wherein the traction gear is a toothed-belt gear.

* * * * *

UNITED STATES PATENT AND TRADEMARK OFFICE

CERTIFICATE OF CORRECTION

PATENT NO. : 7,678,001 B2
APPLICATION NO. : 11/137000
DATED : March 16, 2010
INVENTOR(S) : Seeber It is certified that error appears in the above-identified patent and that said Letters Patent is hereby corrected as shown below:

Title Page
Column 1, item [73], should correctly read:

--GFM Beteiligungs- und Management GmbH & Co KG--

Signed and Sealed this
Nineteenth Day of July, 2011

David J. Kappos

David J. Kappos
*Director of the United States Patent and Trademark Office*